US012745854B2

(12) United States Patent
Alletto, Jr. et al.

(10) Patent No.: US 12,745,854 B2
(45) Date of Patent: Sep. 29, 2026

(54) BEDDING SYSTEM AND METHOD

(71) Applicant: BEDGEAR, LLC, Farmingdale, NY (US)

(72) Inventors: Eugene Alletto, Jr., Glen Head, NY (US); Lorenzo Turicchia, Arlington, MA (US)

(73) Assignee: Bedgear, LLC, Farmingdale, NY (US)

( * ) Notice: Subject to any disclaimer, the term of this patent is extended or adjusted under 35 U.S.C. 154(b) by 185 days.

(21) Appl. No.: 16/520,841

(22) Filed: Jul. 24, 2019

(65) Prior Publication Data

US 2020/0029703 A1 Jan. 30, 2020

Related U.S. Application Data

(60) Provisional application No. 62/703,984, filed on Jul. 27, 2018.

(51) Int. Cl.

| | |
|---|---|
| ***A47C 21/04*** | (2006.01) |
| ***A47C 17/86*** | (2006.01) |
| ***A47C 23/00*** | (2006.01) |

(52) U.S. Cl.

CPC ..... *A47C 21/044* (2013.01); *A47C 17/86* (2013.01); *A47C 23/00* (2013.01)

(58) Field of Classification Search

CPC ..... A47C 7/75; A47C 21/044; A47C 27/007; A47G 9/1036; A61G 7/05784

(Continued)

(56) References Cited

U.S. PATENT DOCUMENTS 4,706,313 A 11/1987 Murphy
4,946,220 A * 8/1990 Wyon ..... A47C 7/74 297/180.13

(Continued)

FOREIGN PATENT DOCUMENTS

EP 0025701 A2 3/1981
WO 2011150215 A1 12/2011

(Continued)

OTHER PUBLICATIONS

International Search Report and Written Opinion of the International Searching Authority, European Patent Office, PCT/US2019/043198, mailed Sep. 17, 2019.

(Continued)

*Primary Examiner* — Justin C Mikowski
(74) *Attorney, Agent, or Firm* — Sorell, Lenna & Schmidt, LLP

(57) ABSTRACT

A bedding system includes a mattress including a sleep surface having air transfer ports. The mattress includes a bottom surface opposite the sleep surface and a side wall that connects the surfaces. The bottom surface and the side wall are made of a material that prevents air flow therethrough. The mattress includes a cavity having a fill material disposed therein and an air flow port that is in communication with the cavity. A hose includes a first end coupled to the air flow port. A pressure generator is coupled to a second end of the hose. The pressure generator is configured to create negative pressure to draw air, moisture or particles in the cavity and/or air transfer ports through the cavity and into the pressure generator and to create positive pressure to move air out of the cavity through the air transfer ports. Methods of use are included.

20 Claims, 10 Drawing Sheets

(58) Field of Classification Search
USPC ..... 5/423
See application file for complete search history.

(56) References Cited

U.S. PATENT DOCUMENTS

| | | | | |
|---|---|---|---|---|
| 5,109,560 | A | 5/1992 | Uetake | |
| 5,299,428 | A * | 4/1994 | Kawaguri | F24F 11/00 236/91 C |
| 5,473,783 | A * | 12/1995 | Allen | A47C 21/044 5/652.2 |
| 6,691,355 | B1 | 2/2004 | Liu | |
| 7,509,998 | B1 * | 3/2009 | Rodney | A47C 21/044 165/138 |
| 7,914,611 | B2 * | 3/2011 | Vrzalik | A61G 7/05715 95/52 |
| 8,191,187 | B2 | 6/2012 | Brykalski et al. | |
| 8,745,784 | B2 | 6/2014 | Cole et al. | |
| 8,806,678 | B2 | 8/2014 | Michael | |
| 9,254,231 | B2 * | 2/2016 | Vrzalik | A61G 7/057 |
| 9,265,352 | B2 | 2/2016 | Oakhill et al. | |
| 9,326,616 | B2 * | 5/2016 | DeFranks | A47C 21/044 |
| 9,433,300 | B2 * | 9/2016 | Gibson | A47C 31/105 |
| 9,463,124 | B2 * | 10/2016 | Lachenbruch | A61G 7/05769 |
| 9,596,946 | B2 | 3/2017 | Scarleski et al. | |
| 9,635,954 | B2 | 5/2017 | Scarleski et al. | |
| 9,756,952 | B2 | 9/2017 | Alletto, Jr. et al. | |
| 9,820,581 | B2 | 11/2017 | Alletto et al. | |
| 10,912,694 | B1 * | 2/2021 | Baksh | A47C 31/005 |
| 2003/0019044 | A1 * | 1/2003 | Larsson | A47C 31/007 5/724 |
| 2003/0046762 | A1 * | 3/2003 | Stolpmann | A61G 7/05776 5/710 |
| 2006/0080778 | A1 * | 4/2006 | Chambers | A47C 21/044 5/652.2 |
| 2007/0261548 | A1 | 11/2007 | Vrzalik et al. | |
| 2008/0028536 | A1 | 2/2008 | Hadden-Cook | |
| 2009/0000031 | A1 * | 1/2009 | Feher | A47C 7/748 5/423 |
| 2014/0033441 | A1 | 2/2014 | Morgan et al. | |
| 2014/0182061 | A1 * | 7/2014 | Zaiss | A47C 21/044 5/423 |
| 2014/0196210 | A1 | 7/2014 | Lachenbruch et al. | |
| 2014/0201909 | A1 * | 7/2014 | Weyl | A61G 7/05715 5/423 |
| 2015/0121620 | A1 * | 5/2015 | Aramli | A47C 21/044 5/423 |
| 2015/0313370 | A1 * | 11/2015 | Rawls-Meehan | A47C 21/044 5/423 |
| 2016/0136385 | A1 * | 5/2016 | Scorcioni | A47C 21/044 600/26 |
| 2017/0295944 | A9 | 10/2017 | Reynolds | |
| 2018/0042393 | A1 | 2/2018 | Alletto et al. | |
| 2018/0085054 | A1 * | 3/2018 | Miles | A61B 5/0205 |
| 2019/0380501 | A1 * | 12/2019 | Reynolds | A47C 21/044 |
| 2020/0029703 | A1 | 1/2020 | Alletto, Jr. et al. | |

FOREIGN PATENT DOCUMENTS

| | | | |
|---|---|---|---|
| WO | 2014072752 | A1 | 5/2014 |
| WO | 2020/023613 | A1 | 1/2020 |

OTHER PUBLICATIONS

Canadian Examination Search Report. Appl No. 3,107,783 . 1 pg. Dec. 29, 2023.
Australia Office Action. Australian Appl No. 2019310460. dtd Jul. 10, 2024.
Notice of Office Action. Korea Appl No. 2021-7025598. 14 pgs. Apr. 26, 2024. Non-English translation.
Australian Examination Report. Australian Application No. 2019310460. Dated Dec. 17, 2024. 1 pg.

* cited by examiner

BEDDING SYSTEM AND METHOD

TECHNICAL FIELD

The present disclosure generally relates to systems configured to create negative pressure and positive pressure to draw moisture and/or particles away from a sleeping surface of a mattress to provide a more pleasant sleeping experience. Methods of use are included.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that suit both their personal sleep preference and body type in order to achieve comfortable, restful sleep.

Mattresses are an important aspect in achieving proper sleep. It is therefore beneficial to provide a mattress capable of drawing moisture and/or particles away from a sleeping surface of a mattress to provide a more pleasant sleeping experience. However, conventional mattresses fail to draw moisture and/or particles away from a sleeping surface of the mattress. This disclosure describes an improvement over these prior art technologies.

SUMMARY

In one embodiment, in accordance with the principles of the present disclosure, a bedding system is provided that includes a mattress having a sleep surface including a plurality of air transfer ports. The mattress includes a bottom surface opposite the sleep surface and a side wall that connects the surfaces. The bottom surface and the side wall are made of a material that prevents air flow therethrough. The mattress comprises a cavity having a fill material disposed therein and an air flow port that is communication with the cavity. A hose comprises a first end coupled to the air flow port. A pressure generator is coupled to a second end of the hose. The pressure generator is configured to create negative pressure to draw air, moisture or particles in the air transfer ports and/or the cavity through the cavity and into the pressure generator and to create positive pressure to move air out of the cavity through the air transfer ports.

In one embodiment, in accordance with the principles of the present disclosure, a bedding system is provided that includes a mattress having a sleep surface including a plurality of air transfer ports. The mattress includes a bottom surface opposite the sleep surface and a side wall that connects the surfaces. The bottom surface and the side wall are made of a material that prevents air flow therethrough. The mattress comprises a first cavity and a second cavity that is spaced apart from the first cavity by a partition. The mattress comprises an air flow port that is in communication with the first cavity. A hose comprises a first end coupled to the air flow port. A pressure generator is coupled to a second end of the hose. The pressure generator is configured to create negative pressure to draw air, moisture or particles in the air transfer ports and/or the first cavity through the first cavity and into the pressure generator and to create positive pressure to move air out of the first cavity through the air transfer ports.

In one embodiment, in accordance with the principles of the present disclosure, a bedding system is provided that includes a mattress having a sleep surface comprising a plurality of air transfer ports. The sleep surface is made from a non-porous material having holes formed therein that define the air transfer ports. The mattress includes a bottom surface opposite the sleep surface and a side wall that connects the surfaces. The bottom surface and the side wall are made of a material that prevents air flow therethrough. The mattress comprises a cavity having a fill material disposed therein and an air flow port that is in communication with the cavity. A hose comprises a first end coupled to the air flow port such that the first end extends into the cavity. A pressure generator is coupled to a second end of the hose. A sensor is configured to send a signal to adjust a fan speed of the pressure generator if a temperature exceeds a selected threshold temperature. The pressure generator is configured to create negative pressure to draw air, moisture or particles in the air transfer ports and/or the cavity through the cavity and into the pressure generator and to create positive pressure to move air out of the cavity through the air transfer ports.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
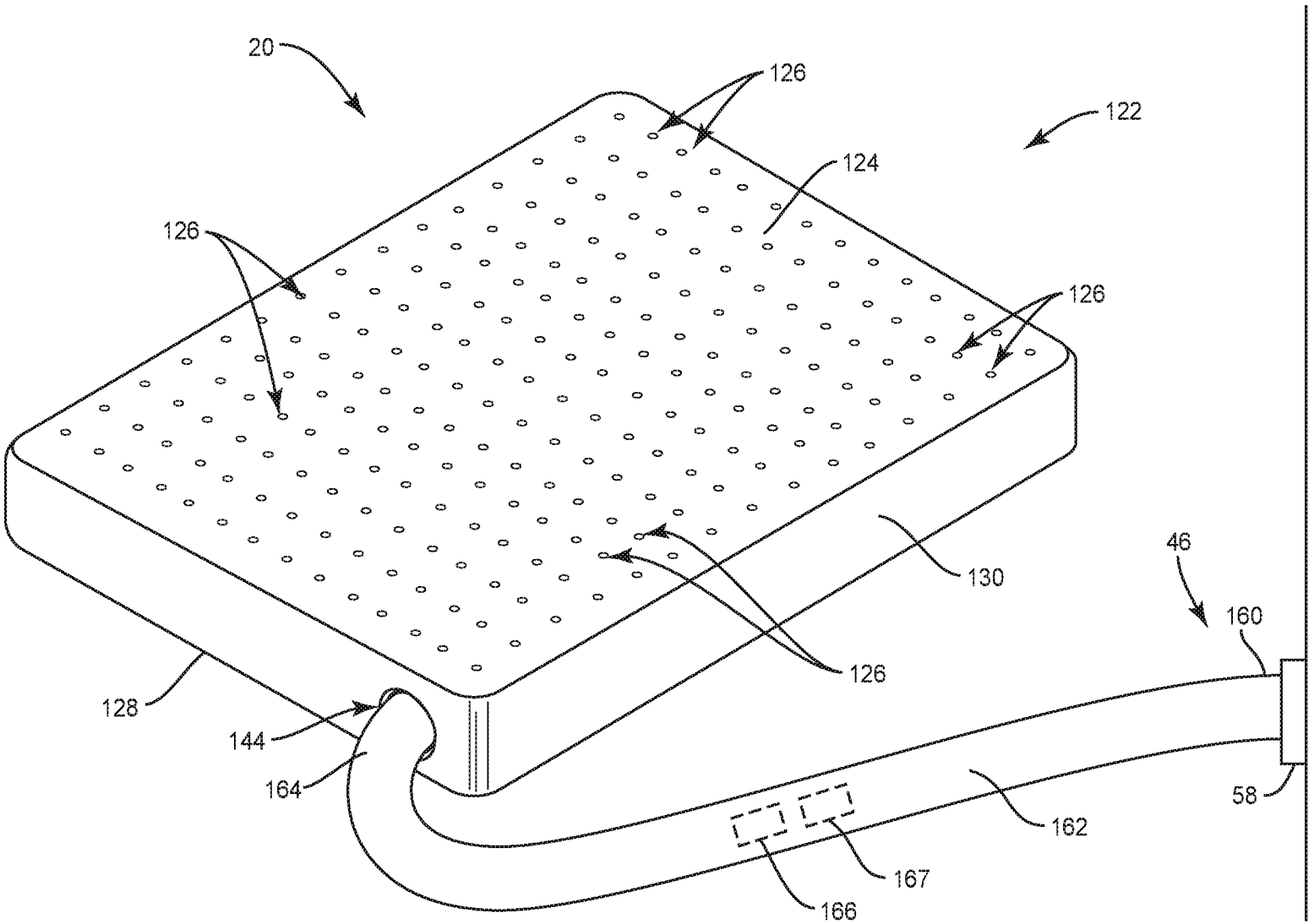
FIG. 1 is a perspective view, in part phantom, of one embodiment of a bedding system in accordance with the principles of the present disclosure.

The exemplary embodiments of a bedding system and methods of use are discussed in terms of a bedding system that creates negative pressure to draw air, moisture or particles in air transfer ports of a cavity through the cavity and into a pressure generator and creates positive pressure to move air out of the cavity through the air transfer ports. The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior."

The following discussion includes a description of a bedding system that creates negative pressure and/or positive pressure, related components and methods of using the bedding system in accordance with the principles of the present disclosure. Alternate embodiments are also disclosed. Reference will now be made in detail to the exemplary embodiments of the present disclosure, which are illustrated in the accompanying figures. Turning to FIGS. 1-9, there are illustrated components of a bedding system 20.

The components of bedding system 20 can be fabricated from materials including textiles, polymers and/or composites, depending on the particular application. For example, the components of bedding system 20, individually or collectively, can be fabricated from materials such as fabrics or textiles, paper or cardboard, cellulosic-based materials, biodegradable materials, plastics and other polymers, metals, semi-rigid and rigid materials. Various components of bedding system 20 may have material composites, including the above materials, to achieve various desired characteristics such as strength, rigidity, elasticity, performance and durability. The components of bedding system 20, individually or collectively, may also be fabricated from a heterogeneous material such as a combination of two or more of the above-described materials. The components of bedding system 20 can be woven, non-woven, knit, extruded, molded, injection molded, cast, pressed and/or machined. The components of bedding system 20 may be monolithically formed, integrally connected or include fastening elements and/or instruments, as described herein.

Bedding system 20 includes a mattress 122. Mattress 122 comprises a sleep surface, such as, for example, a surface 124 having a plurality of spaced apart air transfer ports 126 that extend through a thickness of surface 124. Mattress 122 comprises a bottom surface 128 opposite surface 124 and a side wall 130 that connects surface 124 with surface 128. In some embodiments, wall 130 perimetrically bounds and joins surface 124 with surface 128. In some embodiments, wall 130 extends continuously about perimeters of surface 124 and surface 128. The distance from surface 124 to surface 128 defines a thickness of mattress 122. Wall 130 and/or surface 128 are configured to prevent airflow therethrough. In some embodiments, wall 130 and/or surface 128 is/are free of ports. In some embodiments, ports 126 are uniformly spaced apart and each have a uniform size and/or shape. In some embodiments, ports 126 are uniformly spaced apart and have different sizes and/or shapes. In some embodiments, ports 126 are randomly spaced apart and each have a uniform size and/or shape. In some embodiments, ports 126 are randomly spaced apart and have different sizes and/or shapes. In some embodiments, ports 126 are pores that are inherently present in a material that forms surface 124. For example, in some embodiments surface 124 is formed from a fabric or fabric-like material that is made up of a plurality of woven or non-woven fibers or filaments that are arranged to form the fabric or fabric-like material. The fabric or fabric-like material will thus have gaps between adjacent fibers or filaments that define ports 126. In some embodiments, surface 124 is formed from a non-porous and/or non-breathable base material and holes are cut into the base material to form ports 126. As such, air can only move through ports 126 and is prevented from moving through areas of surface 124 between ports 126. In some embodiments, surface 124 is formed from a breathable material and ports 126 are larger than any pores inherently present in the breathable material that forms surface 124. For example, wherein the breathable material that forms surface 124 is made up of a plurality of woven or non-woven fibers or filaments, the fibers or filaments are cut so that ports 126 each extend through one or more of the fibers or filaments. That is, each port 126 divides one or more of the fibers or filaments into a first portion and a second portion that is separated from the first portion by one of ports 126.

In some embodiments, surface 124 comprises a first material and surface 128 and/or wall 130 comprises a second material. In some embodiments, the second material and/or the first material includes polyester, wool, cotton, Gor-tex, latex, silicone, polyethylene, breathable materials and non-breathable materials with holes punched therein to provide porosity. In some embodiments, the second material is different from the first material. In some embodiments, the second material is the same as the first material. In some embodiments, the second material is a non-permeable material. In some embodiments, the second material prevents the movement of air therethrough in order to direct air in and/or surrounding mattress through surface 124 rather than through surface 128 and/or wall 130, as discussed herein. In some embodiments, surface 128 and/or wall 130 is/are non-porous. For example, in some embodiments, surface 128 and/or wall 130 is/are free of any cavities, openings, etc. such that surface 128 and/or wall 130 act(s) as an air barrier that prevents air from moving through a thickness of surface 128 and/or a thickness of wall 130.

Figure 2:
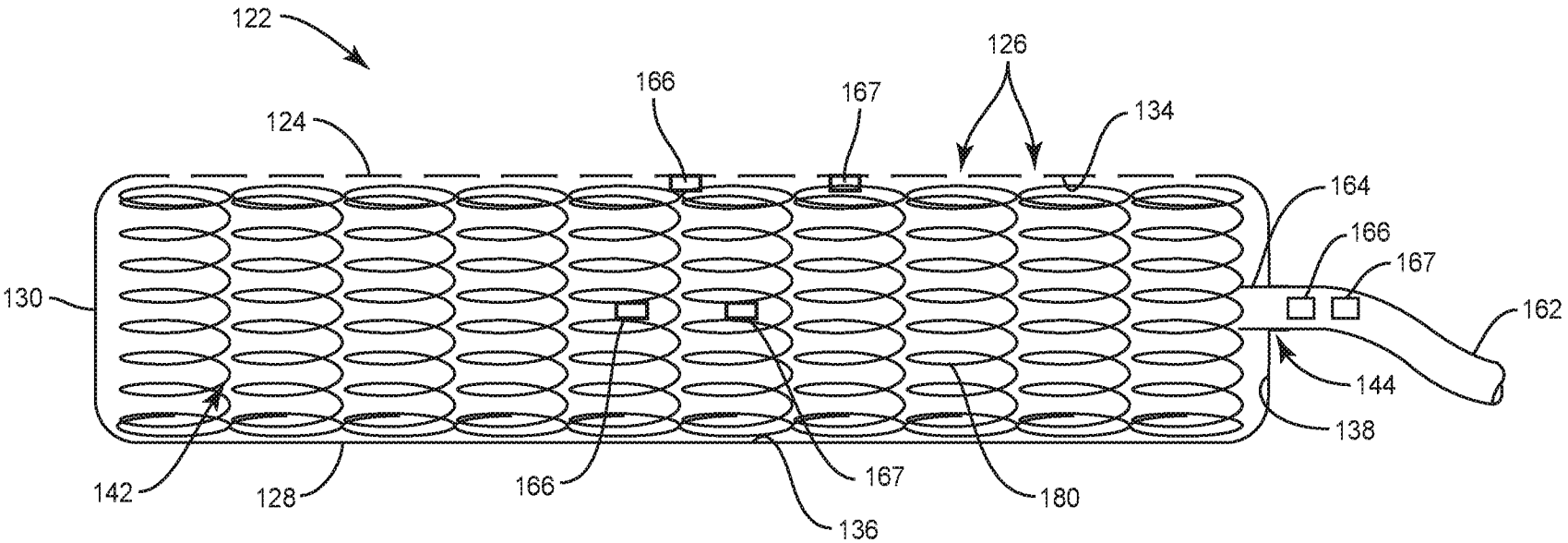
FIG. 2 is a cross sectional view of one embodiment of components of the system as shown in FIG. 1 in accordance with the principles of the present disclosure.

Mattress 122 includes inner surfaces 134, 136, 138 that define a cavity 142 that is communication with ports 126. Cavity 142 is configured for disposal of a fill material. In some embodiments, cavity 142 is filled with a plurality of springs 180, as shown in FIG. 2. Springs 180 are positioned in cavity 142 such that air, moisture and/or particles are permitted to move within and/or around springs 180. This prevents air, moisture and/or particles from being trapped within springs 180 and/or cavity 142. In some embodiments, one or more of springs 180 are enclosed within a pouch. In some embodiments, springs 180 are each positioned within a pocket, such as, for example, a fabric pocket. The pockets may be coupled to one another to form a string of pockets that each include one of springs 180 therein. In some embodiments, the string of pockets includes one or more slits between adjacent pockets to allow springs 180 to move independently of one another. In some embodiments, the string of pockets includes one or more slits that extend through a top surface of the string of pockets between adjacent pockets and/or one or more slits that extend through a bottom surface of the string of pockets between adjacent pockets. In some embodiments, mattress 122 includes a plurality of the strings of pockets. In some embodiments, the strings of pockets are sufficiently spaced apart to allow air, moisture and/or particles to move between adjacent strings of pockets to prevent air, moisture and/or particles from being trapped within the strings of pockets and/or cavity 142.

Mattress 122 includes an air flow port 144 that is in communication with cavity 142. In some embodiments, port 144 extends through wall 130, as shown in FIGS. 1 and 2. In some embodiments, port 144 extends through surfaces 124, 134. In some embodiments, port 144 extends through surfaces 128, 136. It is envisioned that mattress 122 can include only one or a plurality of ports 144. Port 144 is configured to be coupled to a pressure generator 46 so that air, moisture and/or particles in ports 126 and/or cavity 142 is/are drawn into pressure generator 46, or air, moisture and/or particles forced into cavity 142 by pressure generator 46 is/are forced out of cavity 142 through ports 126. This allows pressure generator 46 to draw out air, moisture and/or particles away from surface 124 to provide a more pleasant sleeping experience, as discussed herein. In some embodiments, port 144 extends through wall 130 of mattress 122 such that a hose 162 that is connected with port 144 extends into cavity 142 of mattress 122, as shown in FIG. 2. In some embodiments, hose 162 may be positioned within the fill material in cavity 142. For example, a portion of hose 162 may be positioned between adjacent springs, such as, for example, springs 180 and/or between adjacent strings of pockets.

Figure 3:
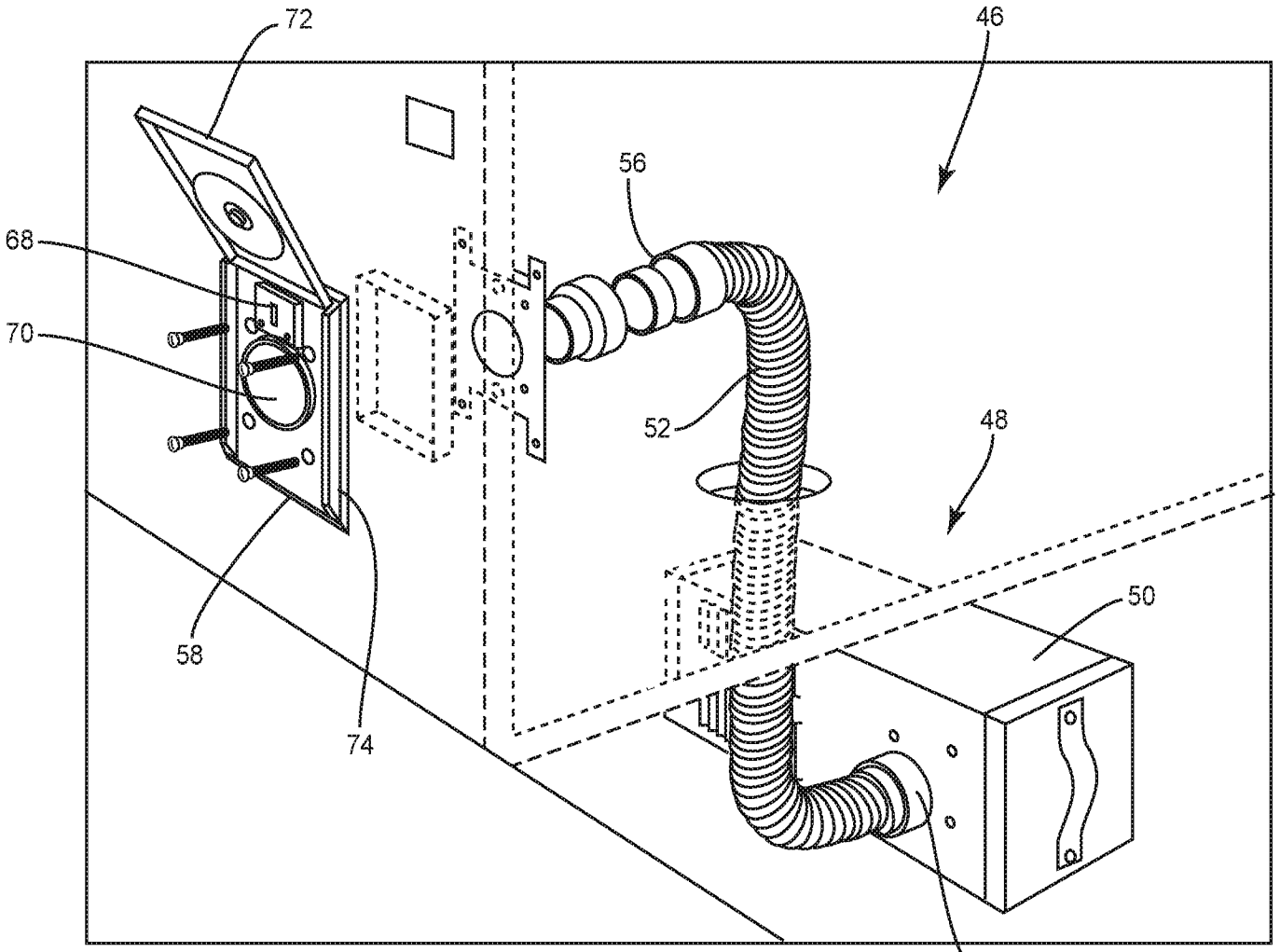
FIG. 3 is a perspective view, in part phantom, of components of the system shown in FIG. 1 in accordance with the principles of the present disclosure.

In some embodiments, pressure generator 46 is incorporated into mattress 122, such as, for example, within cavity 142. In some embodiments, pressure generator 46 is coupled directly to mattress 122. For example, pressure generator 46 may be positioned underneath mattress 122 such that a top surface of pressure generator 46 directly engages surface 128. In some embodiments, pressure generator 46 is a separate unit that is positioned outside of mattress 122. In some embodiments, pressure generator 46 includes a fan. In some embodiments, pressure generator 46 includes a vacuum cleaner. In some embodiments, pressure generator 46 includes a pump. In some embodiments, pressure generator 46 includes a central vacuum system, such as, for example, central vacuum system 48, as shown in FIG. 3. Central vacuum system 48 comprises a power unit 50, a pipe 52 having an end 54 that is connected to power unit 50 and an end 56 that is connected to an outlet 58. Outlet 58 is configured for disposal of an end 160 of a hose 162. An opposite end 164 of hose 162 is configured for disposal in port 144 such that end 164 extends into cavity 142, as shown in FIG. 2. In some embodiments, end 164 is removably disposed in port 144. In some embodiments, end 164 is disposed in port 144 such that hose 162 forms a friction or interference fit with a surface of mattress 122 that port 144 in a manner that prevents air, moisture and/or particles from leaking out of port 144. That is, hose 162 is connected with port 144 such that air, moisture and/or particles within hose 162 can enter cavity 142 without leaking out of port 144 and/or air, moisture and/or particles within cavity 142 can enter hose 162 without leaking out of port 144. In some embodiments, end 164 is permanently and irremovably disposed in port 144. In some embodiments, at least one of pipe 52 and hose 162 is a tube, such, as for example a flexible tube. In some embodiments, bedding system 20 includes one or more caps or covers that cover any unused ports 144. That is, a cap or cover may be coupled to one or more of ports 144 that do not include end 164 disposed therein to prevent air from flowing in or out of cavity 142 through the unused ports 144.

In one embodiment, outlet 58 includes a switch 68, as shown in FIG. 3. Switch 68 is configured to move a flap 70 between a first configuration in which flap 70 is closed and a second configuration in which flap 70 is open. When flap 70 is in the first configuration, hose 162 is devoid of any negative or positive pressure therein. When flap 70 is in the second configuration, any negative pressure or positive pressure created by power unit 50 is communicated into hose 162 to create a vacuum that draws ambient air, moisture and/or particles through cavity 142 or to create positive pressure to force air, moisture and/or particles out of cavity 142. In some embodiments, flap 70 can be opened different amounts when flap 70 is in the second configuration. For example, flap 70 can be fully open or partially open when flap 70 is in the second configuration. It is envisioned that flap 70 may be regulated to have different degrees of being partially opened. This allows the user to regulate the amount of positive or negative pressure in hose 162. In one embodiment, switch 68 is in an extended orientation when flap 70 is in the second configuration and is in a depressed orientation when flap 70 is in the first configuration. In some embodiments, switch 68 is biased to the extended orientation such that the sleeper must move switch 68 from the depressed orientation to the extended orientation in order to move flap 70 from the first configuration to the second configuration. In some embodiments, switch 68 may be moved from the depressed orientation to the extended orientation by disengaging a cover 72 of outlet 58 from a body 74 of outlet 58. That is, cover 72 may be rotated relative to body 74 such that cover 72 no longer presses in on switch 68. In some embodiments, switch 68 may be moved from the extended orientation to the depressed orientation by rotating cover 72 relative to body 74 such that cover 72 engages switch 68 and presses switch 68 inwardly to the depressed orientation.

Power unit 50 includes a motor that is configured to create negative pressure, such as, for example, a vacuum when the motor is in an on position to provide suction within hose 162 to draw air, moisture and/or particles out of cavity 142, as discussed herein. In some embodiments, the motor is also configured to create positive pressure when the motor is in an on position to blow air, moisture and/or particles through hose 162 and into cavity 142, as discussed herein. For example, in some embodiments, the motor may create negative pressure when the motor is in a first position and can be reversed to create positive pressure when the motor is in a second position, and vice versa. When the motor is turned from the on position to an off position, the negative pressure or the positive pressure is stopped. That is, power unit 50 is configured to create a vacuum that provides suction within hose 162 to draw air, moisture and/or particles out of cavity 142 and into pressure generator 46. The negative pressure created by pressure generator 46 causes air, moisture and/or particles in ports 126 to be drawn through cavity 142 and into pressure generator 46. Warm air that is removed from ports 126 is replaced by cooler air, thus providing a cooling effect to sleep surface 124. For example, the temperature of sleep surface 124 may increase due to a person's body temperature, creating an uncomfortable sleep environment. The temperature of sleep surface 124 may be reduced by turning the motor of power unit 50 from the off position to the on position such that power unit 50 creates a vacuum that draws warm air away from sleep surface 124 and replaces the warm air with cooler air. In some embodiments, pressure generator 46 includes a fan, wherein the speed of the fan can be adjusted to provide different amounts of negative pressure. For example, the fan can be set to a low speed to generate a moderate amount of negative pressure. The fan can also be set to a higher speed to generate more negative pressure. This allows a sleeper to regulate the amount of air, moisture and/or particles that is moved in or out of cavity 142 and/or the rate that air, moisture and/or particles move in or out of cavity 142.

Alternatively, power unit 50 may be used to create positive pressure that blows air into cavity 142. As air is blown into cavity 142, air, moisture and/or particles in cavity 142 and/or ports 126 is forced out of ports 126. That is, air, moisture and/or particles within cavity 142 exits cavity 142 through ports 126 and air, moisture and/or particles within ports 126 is forced out of ports and is replaced with ambient air. This allows warm air to be moved away from sleep surface 124, thus providing a cooling effect to sleep surface 124. For example, the temperature of sleep surface 124 may increase due to a person's body temperature, creating an uncomfortable sleep environment. The temperature of sleep surface 124 may be reduced by turning the motor of power unit 50 from the off position to the on position such that power unit 50 creates positive pressure that forces warm air out of cavity 142 through ports 126. In some embodiments, pressure generator 46 may be used in the hospitality industry to remove moisture from mattresses daily. Indeed, when bedsheets are being changed by a chamber maid, he or she can turn power unit 50 on such that pressure generator 46 creates positive pressure that forces air, moisture and/or particles out of cavity 142 through ports 126 and forces air, moisture and/or particles in ports 126 out of ports and replaces the air, moisture and/or particles with ambient air. In some embodiments, pressure generator 46 includes a fan, wherein the speed of the fan can be adjusted to provide different amounts of positive pressure. For example, the fan can be set to a low speed to generate a moderate amount of positive pressure. The fan can also be set to a higher speed to generate more positive pressure.

Should a sleeper desire to decrease the temperature of sleep surface 124, the sleeper can use a remote control, for example, to turn the motor of power unit 50 from the off position to the on position such that power unit 50 creates a vacuum that draws ambient air in ports 126 through cavity 142 and into pressure generator 46, or creates positive pressure to force air, moisture and/or particles through cavity 142 and ports 126. Likewise, the sleeper can use the remote control, for example, to increase the fan speed of power unit 50 to strengthen the vacuum and draw ambient air in ports 126 through cavity 142 and into pressure generator 46, increase positive pressure to force air, moisture and/or particles through cavity 142 and ports 126. When sleep surface 124 reaches a comfortable temperature, the sleeper can operate the remote control to turn the motor of power unit 50 from the on position to the off position to terminate any negative pressure or positive pressure and/or operate the remote control to decrease the fan speed of power unit 50 to decrease any negative pressure or positive pressure.

In some embodiments, central vacuum system 48 comprises a temperature sensor configured to send a signal to the power sensor to move the motor from the off position to the on position and/or to increase the fan speed of power unit 50 when the temperature sensor detects a temperature above a threshold temperature. This allows power unit 50 to create a vacuum that draws ambient air in ports 126 through cavity 142 and into pressure generator 46 or create positive pressure to force air, moisture and/or particles through cavity 142 and ports 126. In some embodiments, the temperature sensor is configured to send a signal to the power sensor to move the motor from the on position to the off position and/or decrease the fan speed of power unit 50 when the temperature sensor detects a temperature below a threshold temperature. This terminates or reduces any negative pressure or positive pressure.

In some embodiments, mattress 122 comprises a temperature sensor 166 configured to send a signal to the power sensor to move the motor from the off position to the on position and/or increase the fan speed of power unit 50 when temperature sensor 166 detects a temperature above a threshold temperature. This allows power unit 50 to create a vacuum that draws ambient air in ports 126 through cavity 142 and into pressure generator 46 or create positive pressure to force air, moisture and/or particles through cavity 142 and ports 126. In some embodiments, temperature sensor 166 is positioned inside of hose 162. In some embodiments, temperature sensor 166 is positioned beneath surface 124. In some embodiments, temperature sensor 166 is positioned on top of surface 124. In some embodiments, temperature sensor 166 is positioned within the fill material of mattress 122, such as, for example, in or adjacent to one or more of springs 180. In some embodiments, temperature sensor 166 is configured to send a signal to the power sensor to move the motor from the on position to the off position and/or decrease the fan speed of power unit 50 when temperature sensor 166 detects a temperature below a threshold temperature. This terminates or reduces any negative pressure or positive pressure.

In some embodiments, mattress 122 comprises a humidity sensor 167 configured to send a signal to the power sensor to move the motor from the off position to the on position and/or increase the fan speed of power unit 50 when humidity sensor 167 detects a humidity above a threshold humidity. This allows power unit 50 to create a vacuum that draws ambient air in ports 126 through cavity 142 and into pressure generator 46 or create positive pressure to force air, moisture and/or particles through cavity 142 and ports 126. In some embodiments, humidity sensor 167 is positioned inside of hose 162. In some embodiments, humidity sensor 167 is positioned beneath surface 124. In some embodiments, humidity sensor 167 is positioned on top of surface 124. In some embodiments, humidity sensor 167 is positioned within the fill material of mattress 122, such as, for example, in or adjacent to one or more of springs 180. In some embodiments, humidity sensor 167 is configured to send a signal to the power sensor to move the motor from the on position to the off position and/or decrease the fan speed of power unit 50 when humidity sensor 167 detects a humidity below a threshold humidity. This terminates or reduces any negative pressure or positive pressure.

In some embodiments, hose 162 comprises a switch that is in communication with the motor of power unit 50. The switch is configured to move the motor between the on and off positions and/or increase or decrease the fan speed of power unit 50. For example, should a sleeper desire to decrease the temperature and/or humidity of sleep surface 124, the sleeper can operate the switch on hose 162 to turn the motor of power unit 50 from the off position to the on position and/or increase the fan speed of power unit 50 such that power unit 50 creates a vacuum that draws ambient air in ports 126 through cavity 142 and into pressure generator 46 or creates positive pressure to force air, moisture and/or particles out of cavity 142 and ports 126. When sleep surface 124 reaches a comfortable temperature and/or humidity, the sleeper can operate the switch on hose 162 to turn the motor of power unit 50 from the on position to the off position and/or decrease the fan speed of power unit 50 to terminate or reduce any negative pressure or positive pressure.

Figure 4:
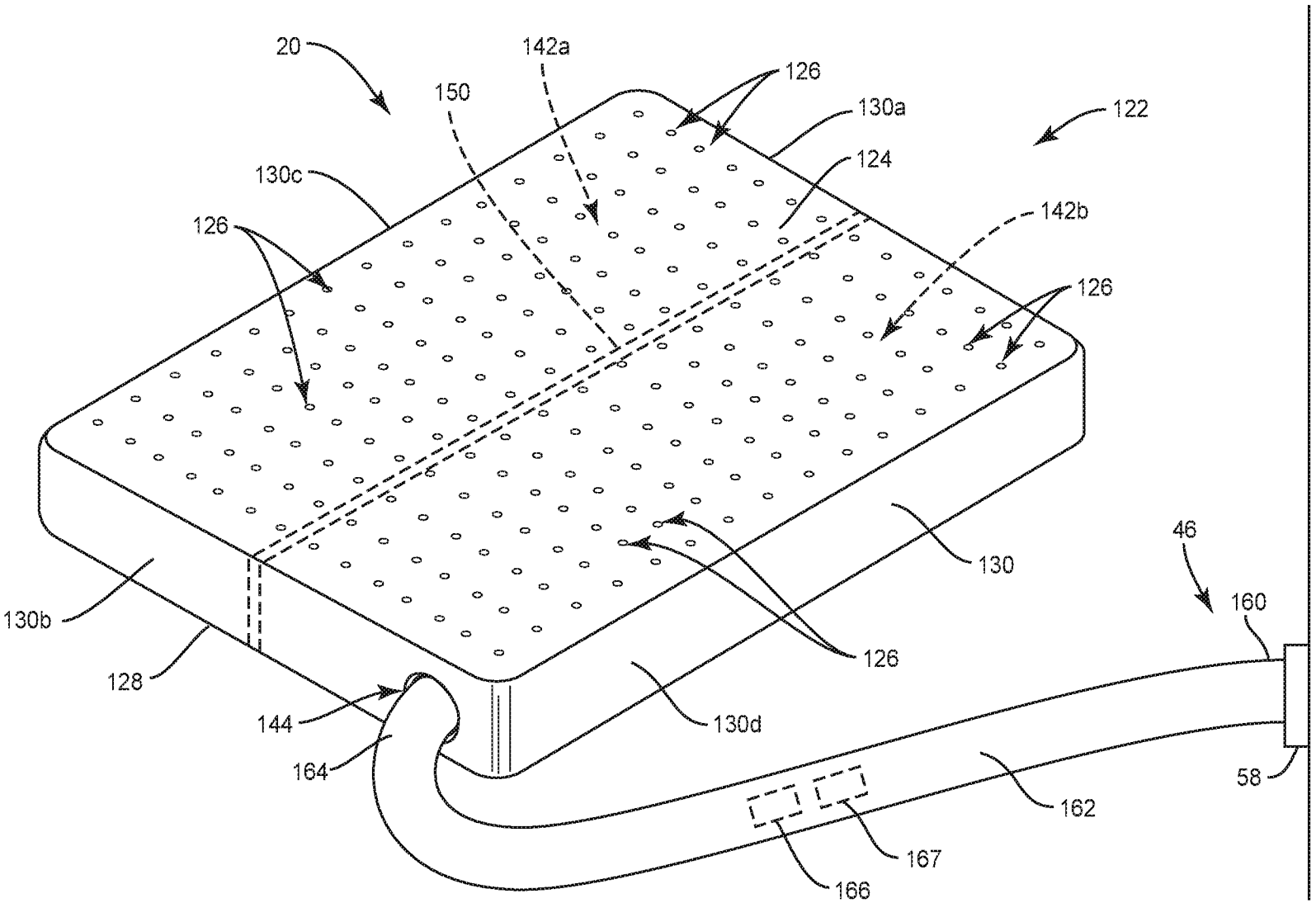
FIG. 4 is a perspective view, in part phantom, of one embodiment of the system shown in FIG. 1 in accordance with the principles of the present disclosure.
Figure 5:
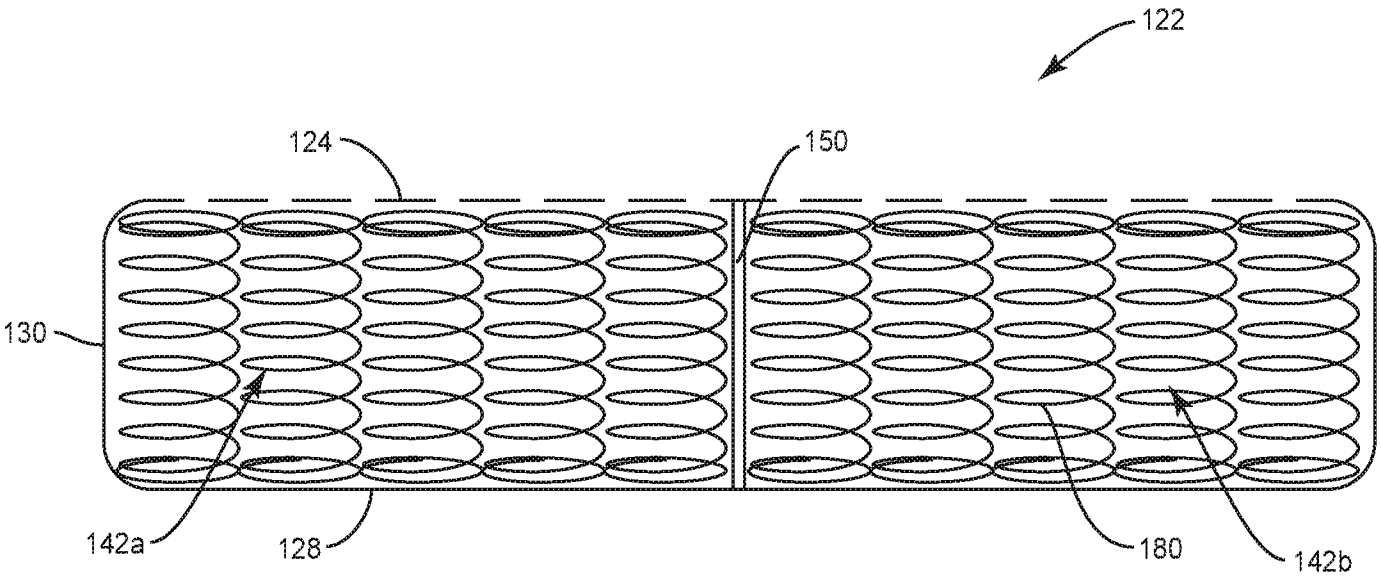
FIG. 5 is a cross sectional view of one embodiment of components of the system shown in FIG. 4 in accordance with the principles of the present disclosure.

In one embodiment, shown in FIGS. 4-9, mattress 122 includes a partition 150 that divides cavity 142 into a first cavity 142*a* and a second cavity 142*b*. Cavity 142*a* has a length that extends from an end 130*a* of wall 130 to an opposite end 130*b* of wall 130 and a width that extends from partition 150 to a side 130*c* of wall 130. Cavity 142*b* has a length that extends from end 130*a* to end 130*b* and a width that extends from partition 150 to a side 130*d* of wall 130. Partition 150 includes an end that directly engages end 130*a* and an opposite end that directly engages end 130*b*. Partition 150 includes a top surface that directly engages surface 124 and an opposite bottom surface that directly engages surface 128. Partition 150 is configured to prevent airflow therethrough. That is, partition 150 prevents air, moisture and/or particles in cavity 142*a* from moving into cavity 142*b* and prevents air, moisture and/or particles in cavity 142*b* from moving into cavity 142*a*. In some embodiments, partition 150 is non-porous. In some embodiments, partition 150 includes a porous material that is coated or laminated with a material, such as, for example, plastic and/or other polymers to make partition 150 non-porous. As shown in FIG. 4, port 144 is in communication with cavity 142*b* such that power unit 50 creates a vacuum that draws ambient air in ports 126 through cavity 142*b* and into pressure generator 46 or creates positive pressure to force air, moisture and/or particles out of cavity 142*b* and ports 126. This configuration allows system 20 to regulate the temperature, humidity, etc. of surface 124 directly above cavity 142*b* using pressure generator 46, while leaving the temperature, humidity, etc. of surface 124 directly above cavity 142*a* unaltered. As such, a sleeper who desires to alter the temperature, humidity, etc. of surface 124 will lay on surface 124 directly above cavity 142*b* and a sleeper who does not desire to alter the temperature, humidity, etc. of surface 124 will lay on surface 124 directly above cavity 142*a*. Indeed, because cavity 142*a* is separated from cavity 142*b* by partition 150, a vacuum created by power unit 50 will draw ambient air in ports 126 through cavity 142*b* and into pressure generator 46 but will not draw ambient air in ports 126 through cavity 142*a* and into pressure generator 46. Likewise, positive pressure created by power unit 50 will force air, moisture and/or particles out of cavity 142*b* and ports 126, but will not force air, moisture and/or particles out of cavity 142*a*.

Figure 6:
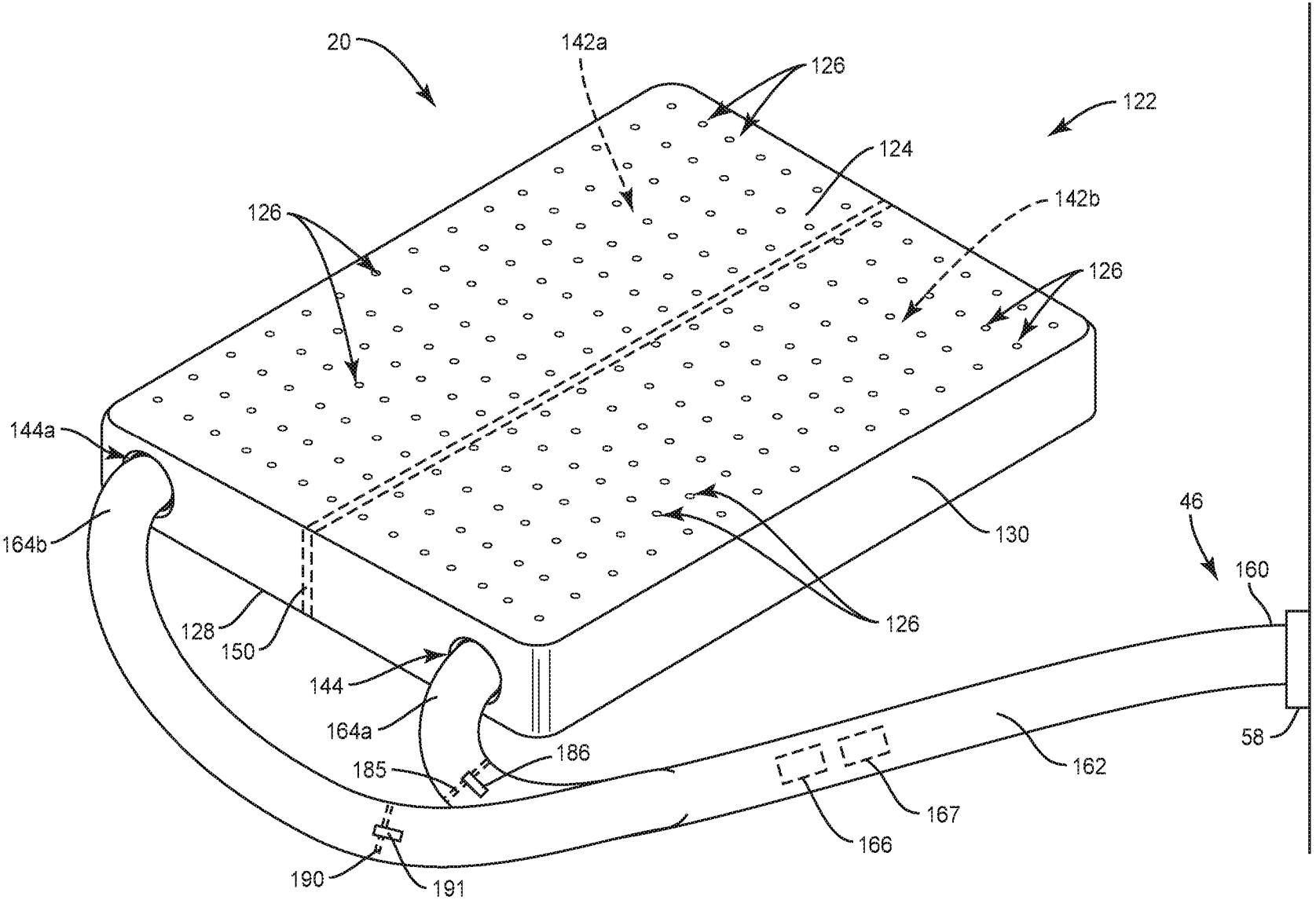
FIG. 6 is a perspective view, in part phantom, of one embodiment of the system shown in FIG. 1 in accordance with the principles of the present disclosure.

In one embodiment, shown in FIG. 6, air flow port 144 is in communication with cavity 142*b* and mattress 122 includes an air flow port 144*a* that is in communication with cavity 142*a*. End 164 of hose 162 includes a first section 164*a* that is coupled to air flow port 144 and a second section 164*b* that is coupled to air flow port 144*a*. Power unit 50 creates a vacuum that draws ambient air in ports 126 through cavities 142*a*,142*b* simultaneously and into pressure generator 46 or creates positive pressure to force air, moisture and/or particles out of cavities 142*a*,142*b* and ports 126 simultaneously. It is envisioned that this configuration can allow system 20 to regulate the temperature, humidity, etc. of surface 124 directly above cavities 142*a*,142*b* using pressure generator 46 more effectively than mattresses that include only one air flow port and are hence connected to pressure generator 46 only once. Indeed, connecting pressure generator 46 to mattress 122 at two places allows pressure regulator to create an equal amount of negative or positive pressure at both places to ensure that the force of the negative or positive pressure is approximately equal at both places. This overcomes problems associated by weak negative or positive pressure in a cavity, such as, for example, cavity 142*a* or cavity 142*b* that is furthest from a port that pressure generator 46 is connected to. For example, in mattresses that have only one port, the port may be closer to cavity 142*a* or cavity 142*b*. Pressure generator will therefore generate more positive pressure or negative pressure in the cavity that is closest to the port. However, connecting pressure generator 46 to mattress 122 at two places in the manner described herein provides a solution to such a problem.

Figure 6A:
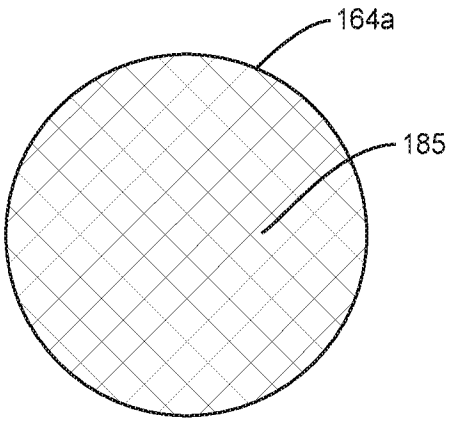
FIG. 6A is a side view of components of the system shown in FIG. 1.
Figure 6B:
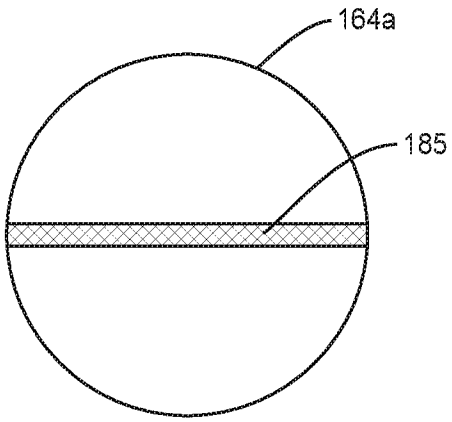
FIG. 6B is a side view of components of the system shown in FIG. 1.
Figure 6C:
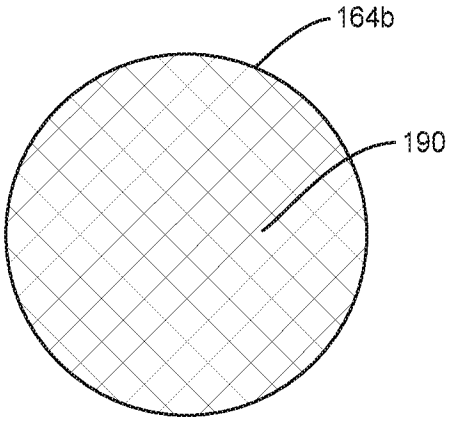
FIG. 6C is a side view of components of the system shown in FIG. 1.
Figure 6D:
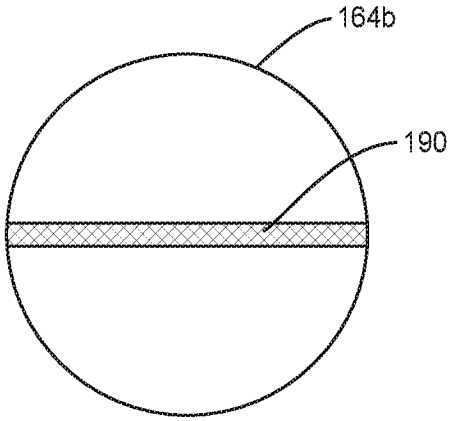
FIG. 6D is a side view of components of the system shown in FIG. 1.

In some embodiments, hose 162 includes a damper 185 within section 164*a* and a damper 190 within section 164*b*. A lever, such as, for example, a handle 186 is attached to damper 185 to rotate damper 185 relative to hose 162 between a first orientation in which damper 185 completely blocks hose 162, as shown in FIG. 6A and a second orientation in which damper 185 only blocks a portion of hose 162, as shown in FIG. 6B. When damper 185 is in the first orientation, damper 185 prevents positive pressure created by pressure generator 46 from entering cavity 142*b* or prevents air, moisture and/or particles in cavity 142*b* from moving into pressure generator 46. When damper 185 is in the second orientation, damper 185 allows positive pressure created by pressure generator 46 to enter cavity 142*b* or allows air, moisture and/or particles in cavity 142*b* to move into pressure generator 46 in response to negative pressure created by pressure generator 46. Likewise, a lever, such as, for example, a handle 191 is attached to damper 190 to rotate damper 190 relative to hose 162 between a first orientation in which damper 190 completely blocks hose 162, as shown in FIG. 6C and a second orientation in which damper 190 only blocks a portion of hose 162, as shown in FIG. 6D. When damper 190 is in the first orientation, damper 190 prevents positive pressure created by pressure generator 46 from entering cavity 142*a* or prevents air, moisture and/or particles in cavity 142*a* from moving into pressure generator 46. When damper 190 is in the second orientation, damper 190 allows positive pressure created by pressure generator 46 to enter cavity 142*a* or allows air, moisture and/or particles in cavity 142*a* to move into pressure generator 46 in response to negative pressure created by pressure generator 46. In some embodiments, handle 186 may be rotated relative to hose 162 to position damper 185 anywhere between the first and second orientations of damper 185 and handle 191 may be rotated relative to hose 162 to position damper 190 anywhere between the first and second orientations of damper 190.

Dampers 185, 190 allow sleepers to manually regulate the amount of positive pressure that enters cavities 142*a*, 142*b* and/or the amount of negative pressure in cavities 142*a*, 142*b*. Dampers 185, 190 also allow sleepers to manually prevent positive pressure from entering cavities 142*a*, 142*b* and/or negative pressure in cavities 142*a*, 142*b*. For example, should a sleeper laying on surface 124 directly above cavity 142*a* and a sleeper laying on surface 124 directly above cavity 142*b* desire to prevent negative or positive pressure in cavities 142*a*, 142*b*, the sleepers can move dampers 185, 190 to the first orientations. This will prevent pressure generator 46 from drawing ambient air in ports 126 through cavity 142 and into pressure generator 46 or prevent air, moisture and/or particles in cavity 142 from exiting cavity 142 through ports 126. Alternatively, should a sleeper laying on surface 124 directly above cavity 142*a* desire to prevent negative or positive pressure in cavity 142*a*, but a sleeper laying on surface 124 directly above cavity 142*b* desires to have negative or positive pressure in cavity 142*b* to draw ambient air in ports 126 through cavity 142*b* and into pressure generator 46 or prevent air, moisture and/or particles in cavity 142*b* from exiting cavity 142*b* through ports 126, the sleepers can move damper 185 to the first orientation and move damper 190 to the second orientation. Likewise, should a sleeper laying on surface 124 directly above cavity 142*b* desire to prevent negative or positive pressure in cavity 142*b*, but a sleeper laying on surface 124 directly above cavity 142*a* desires to have negative or positive pressure in cavity 142*a* to draw ambient air in ports 126 through cavity 142*a* and into pressure generator 46 or prevent air, moisture and/or particles in cavity 142*a* from exiting cavity 142*a* through ports 126, the sleepers can move damper 185 to the second orientation and move damper 190 to the first orientation.

Figure 7:
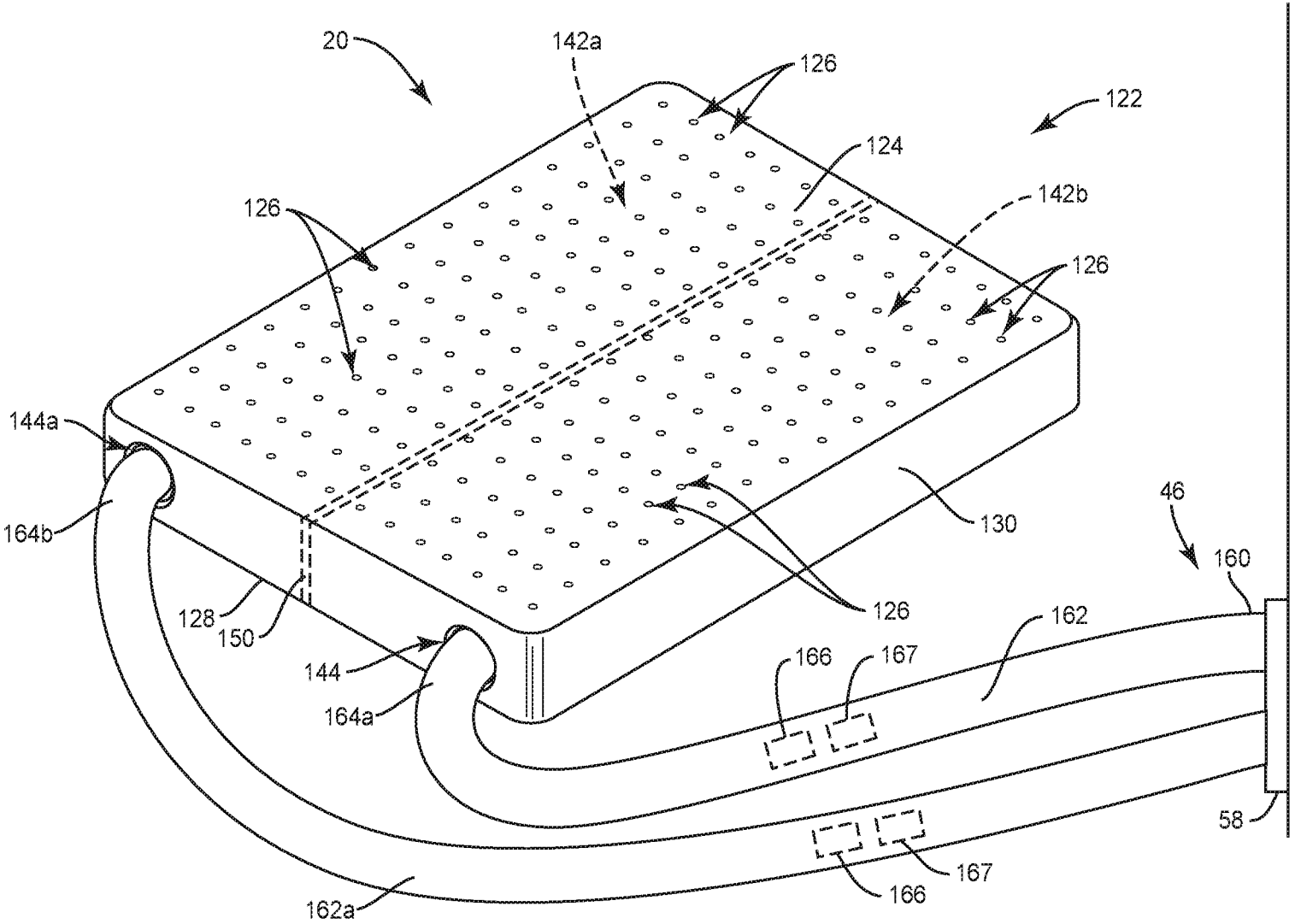
FIG. 7 is a perspective view, in part phantom, of one embodiment of the system shown in FIG. 1 in accordance with the principles of the present disclosure.

In one embodiment, shown in FIG. 7, central vacuum system 48 comprises two power units 50. One pipe 52 is connected to one of power units 50 and to outlet 58. Another pipe 52 is connected to the other power unit 50 and to outlet 58. An end of hose 162 is coupled to outlet 58 and an opposite end of hose 162 is coupled to port 144 such that a first one of power units 50 can create negative pressure to draw air, moisture and/or particles in cavity 142*b* into hose 162 or create positive pressure to move air, moisture and/or particles in cavity 142*b* out of cavity 142*b* through ports 126 above cavity 142*b*. An end of a hose 162*a* that is the same or similar to hose 162 is coupled to outlet 58 and an opposite end of hose 162*a* is coupled to port 144*a* such that a second one of power units 50 can create negative pressure to draw air, moisture and/or particles in cavity 142*a* into hose 162*a* or create positive pressure to move air, moisture and/or particles in cavity 142*a* out of cavity 142*a* through ports 126 above cavity 142*a*. This allows airflow in or out of cavity 142*a* to be regulated independently of airflow in or out of cavity 142*b*. For example, should a sleeper who is laying on surface 124 directly above cavity 142*a* desire more airflow than a sleeper who is laying on surface 124 directly above cavity 142*b*, he or she can increase a fan speed of the power unit 50 that is connected with hose 162*a* such that the fan speed of the power unit 50 that is connected with hose 162*a* is greater than the fan speed of the power unit 50 that is connected with hose 162. Alternatively, should a sleeper who is laying on surface 124 directly above cavity 142*a* desire less airflow than a sleeper who is laying on surface 124 directly above cavity 142*b*, he or she can decrease a fan speed of the power unit 50 that is connected with hose 162*a* such that the fan speed of the power unit 50 that is connected with hose 162*a* is less than the fan speed of the power unit 50 that is connected with hose 162.

This configuration also provides the ability to program system 20 such that the power unit 50 that is connected with hose 162*a* turns on or off at different times than the power unit 50 that is connected with hose 162 and/or changes the fan speed such that the fan speed of the power unit 50 that is connected with hose 162*a* is different than the fan speed of the power unit 50 that is connected with hose 162. For example, sensor 166 within hose 162*a* can send a signal to the power unit 50 that is connected with hose 162*a* when the temperature within hose 162*a* reaches a first threshold temperature to cause the power unit 50 that is connected with hose 162*a* to turn on and/or increase the fan speed of the power unit 50 that is connected with hose 162*a*. Likewise, sensor 166 within hose 162 can send a signal to the power unit 50 that is connected with hose 162 when the temperature within hose 162 reaches a second threshold temperature to cause the power unit 50 that is connected with hose 162 to turn on and/or increase the fan speed of the power unit 50 that is connected with hose 162. In some embodiments, the first threshold temperature is greater than the second threshold temperature such that the power unit 50 that is connected with hose 162 will turn on and/or increase the fan speed of the power unit 50 that is connected with hose 162 before the power unit 50 that is connected with hose 162*a* turns on and/or increases the fan speed of the power unit 50 that is connected with hose 162*a*. In some embodiments, the first threshold temperature is less than the second threshold temperature such that the power unit 50 that is connected with hose 162 will turn on and/or increase the fan speed of the power unit 50 that is connected with hose 162 after the power unit 50 that is connected with hose 162*a* turns on and/or increases the fan speed of the power unit 50 that is connected with hose 162*a*.

Figure 8:
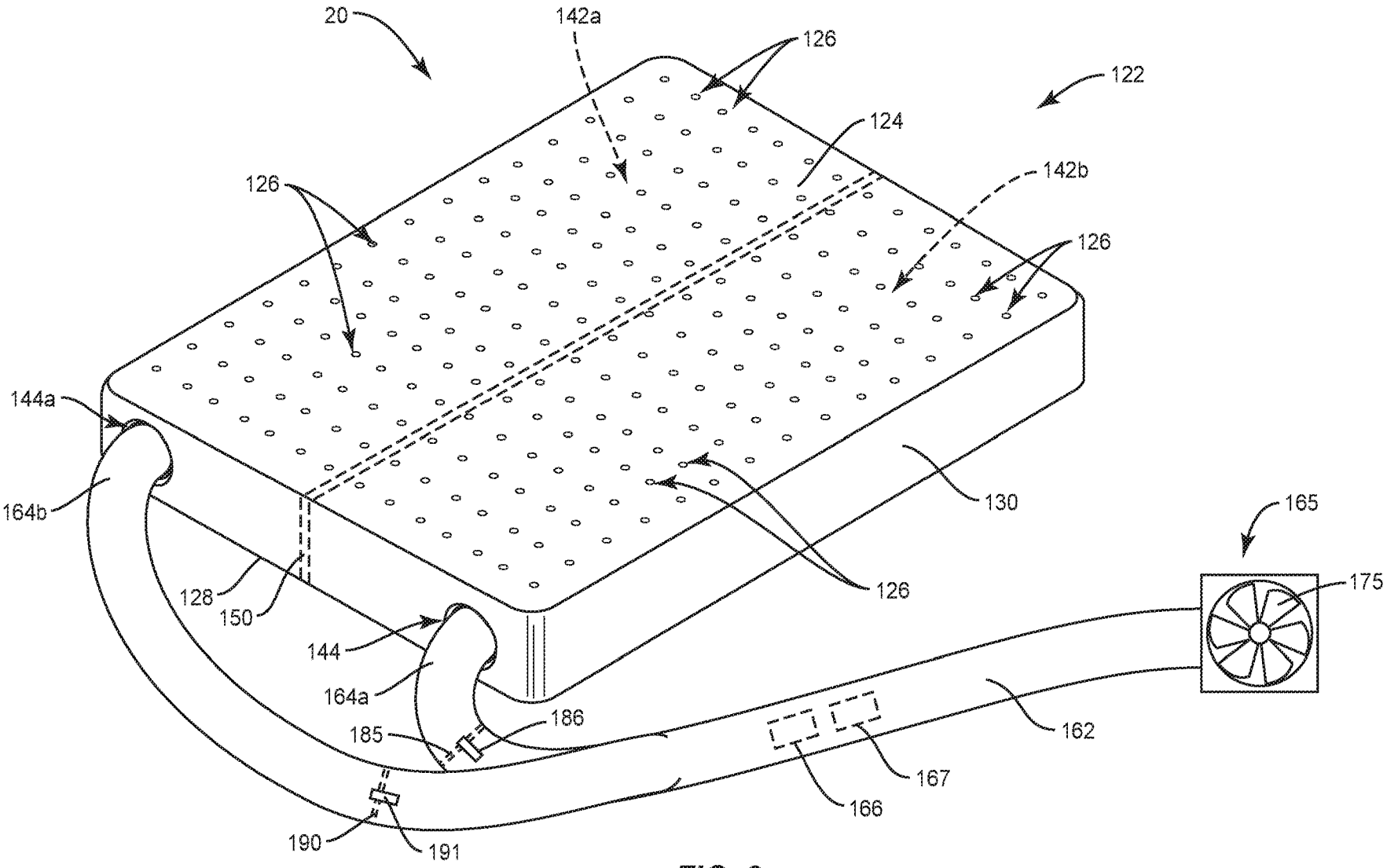
FIG. 8 is a perspective view, in part phantom, of one embodiment of the system shown in FIG. 1 in accordance with the principles of the present disclosure.

In one embodiment, shown in FIG. 8, air flow port 144 is in communication with cavity 142*b* and air flow port 144*a* is in communication with cavity 142*a*. Section 164*a* is coupled to air flow port 144 and section 164*b* is coupled to air flow port 144*a*. End 160 of hose 162 is connected to a pressure generator, such as, for example, a pump 165. Pump 165 includes a fan 175 configured to generate negative pressure to draw air, moisture and/or particles in cavities 142*a*, 142*b* into hose 162 and/or generate positive pressure to move air, moisture and/or particles in cavities 142*a*, 142*b* out of cavities 142*a*, 142*b* through ports 126. It is envisioned that pump 165 can be variously positioned with respect to mattress 122. For example, in one embodiment, pump 165 is positioned on the same surface that mattress 122 is positioned on, such as, for example, the floor of a room, as shown in FIG. 8. In some embodiments, pump 165 is positioned within mattress 122, such as, for example, within cavity 142*a* and/or cavity 142*b*. In some embodiments, pump 165 is positioned underneath mattress 122 such that surface 128 directly engages a top surface of pump 165.

Pump 165 is configured to create a vacuum that draws ambient air in ports 126 through cavities 142*a*,142*b* simultaneously and into pump 165 or creates positive pressure to force air, moisture and/or particles out of cavities 142*a*,142*b* and ports 126 simultaneously. It is envisioned that this configuration can allow system 20 to regulate the temperature, humidity, etc. of surface 124 directly above cavities 142*a*,142*b* using pump 165 more effectively than mattresses that include only one air flow port and are hence connected to pump 165 only once. Indeed, connecting pump 165 to mattress 122 at two places allows pump 165 to create an equal amount or substantially equal amount of negative or positive pressure at both places to ensure that the force of the negative or positive pressure is approximately equal at both places. This overcomes problems associated by weak negative or positive pressure in a cavity, such as, for example, cavity 142*a* or cavity 142*b* that is furthest from a port that pump 165 is connected to. For example, in mattresses that have only one port, the port may be closer to cavity 142*a* or cavity 142*b*. Pump 165 will therefore generate more positive pressure or negative pressure in the cavity that is closest to the port. However, connecting pump 165 to mattress 122 at two places in the manner described herein provides a solution to such a problem.

Figure 9:
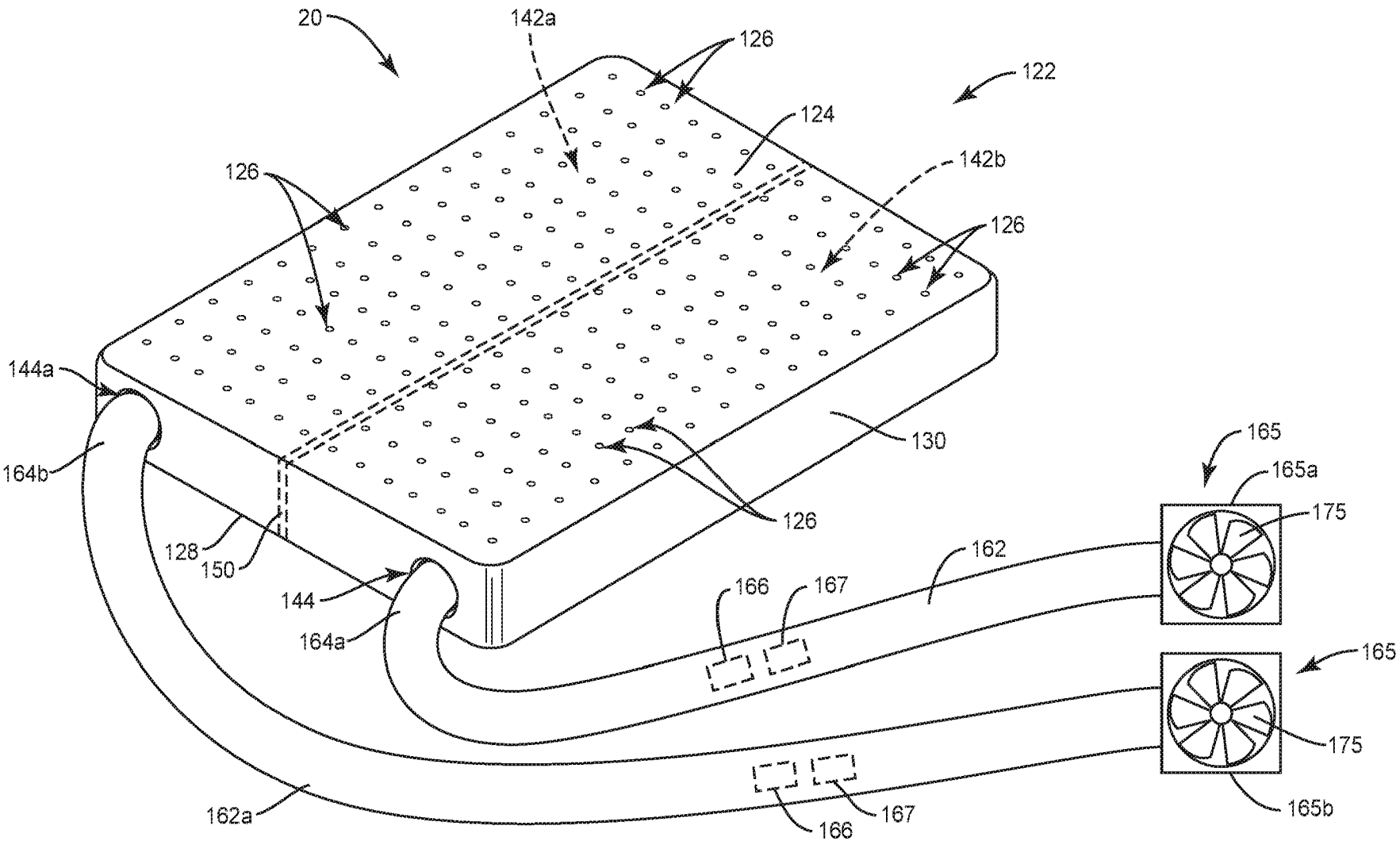
FIG. 9 is a perspective view, in part phantom, of one embodiment of the system shown in FIG. 1 in accordance with the principles of the present disclosure.

In one embodiment, shown in FIG. 9, system 20 comprises two pumps 165, which are shown in FIG. 9 as pump 165*a* and pump 165*b*. An end of hose 162 is coupled to pump 165*a* and an opposite end of hose 162 is coupled to port 144 such that pump 165*a* can create negative pressure to draw air, moisture and/or particles in cavity 142*b* into hose 162 or create positive pressure to move air, moisture and/or particles in cavity 142*b* out of cavity 142*b* through ports 126 above cavity 142*b*. An end of hose 162*a* is coupled to pump 165*b* and an opposite end of hose 162*a* is coupled to port 144*a* such that pump 165*b* can create negative pressure to draw air, moisture and/or particles in cavity 142*a* into hose 162*a* or create positive pressure to move air, moisture and/or particles in cavity 142*a* out of cavity 142*a* through ports 126 above cavity 142*a*. This allows airflow in or out of cavity 142*a* to be regulated independently of airflow in or out of cavity 142*b*. For example, should a sleeper who is laying on surface 124 directly above cavity 142*a* desire more airflow than a sleeper who is laying on surface 124 directly above cavity 142*b*, he or she can increase a fan speed of pump 165*b* such that the fan speed of pump 165*b* is greater than the fan speed of pump 165*a*. Alternatively, should a sleeper who is laying on surface 124 directly above cavity 142*a* desire less airflow than a sleeper who is laying on surface 124 directly above cavity 142*b*, he or she can decrease a fan speed of pump 165*b* such that the fan speed of pump 165*b* is less than the fan speed of pump 165*a*.

This configuration also provides the ability to program system 20 such that pump 165*b* turns on or off at different times than pump 165*a* and/or changes the fan speed such that the fan speed of pump 165*b* is different than the fan speed of pump 165*a*. For example, sensor 166 within hose 162*a* can send a signal to pump 165*b* when the temperature within hose 162*a* reaches a first threshold temperature to cause pump 165*b* to turn on and/or increase the fan speed of pump 165*b*. Likewise, sensor 166 within hose 162 can send a signal to pump 165*a* when the temperature within hose 162 reaches a second threshold temperature to cause pump 165*a* to turn on and/or increase the fan speed of pump 165*a*. In some embodiments, the first threshold temperature is greater than the second threshold temperature such that pump 165*a* will turn on and/or increase the fan speed of pump 165*a* before pump 165*b* turns on and/or increases the fan speed of pump 165*b*. In some embodiments, the first threshold temperature is less than the second threshold temperature such that pump 165*a* will turn on and/or increase the fan speed of pump 165*a* after pump 165*b* turns on and/or increases the fan speed of pump 165*b*.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A bedding system comprising:

a mattress including a top wall comprising a sleep surface and an opposite inner surface, the sleep surface defining an unobstructed topmost surface of the mattress, the top wall having a plurality of air transfer ports extending through the sleep surface to the opposite inner surface, the air transfer ports being spaced apart, the top wall being made from a breathable material, the air transfer ports being larger than any pores inherently present in the breathable material, the mattress including a bottom wall comprising a bottom surface and an opposite inner surface, the bottom surface being opposite the sleep surface, the mattress including a side wall that connects the top wall and the bottom wall, the bottom wall and the side wall being made of a material that prevents air flow therethrough, the inner surfaces of the top and bottom walls and an inner surface of the side wall defining a cavity having a fill material disposed therein such that the fill material extends from the inner surface of the top wall to the inner surface of the bottom wall, at least one of the walls defining a hole extending therethrough, the hole being in communication with the cavity;

a hose comprising a first end positioned in the hole such that the hose is positioned equidistant between the top and bottom walls; and a pressure generator coupled to a second end of the hose, wherein the pressure generator is configured to create negative pressure to draw air, moisture or particles in the air transfer ports and/or the cavity through the cavity and into the pressure generator, and wherein the system includes first and second sensors each configured to send a signal to adjust a fan speed of the pressure generator, the first sensor being positioned in the mattress, the second sensor engaging the sleep surface and being positioned between two of the air transfer ports such that the second sensor is spaced apart from each of the air transfer ports.

2. A bedding system as recited in claim 1, wherein the breathable material is made up of a plurality of woven fibers, the fibers being cut so that the air transfer ports each extend through one or more of the fibers.

3. A bedding system as recited in claim 2, wherein each of the air transfer ports divides one or more of the fibers into a first portion and a second portion that is separated from the first portion by one of the air transfer ports.

4. A bedding system as recited in claim 1, wherein the fill material comprises a plurality of springs, the springs extending continuously from the inner surface of the top wall to the inner surface of the bottom wall.

5. A bedding system as recited in claim 4, wherein the system includes a third sensor configured to send a signal to adjust the fan speed of the pressure generator, the third sensor being positioned in the hose.

6. A bedding system as recited in claim 4, wherein the system includes a temperature sensor configured to send a signal to adjust the fan speed of the pressure generator, the temperature sensor being positioned in the hose.

7. A bedding system as recited in claim 4, wherein the system includes a humidity sensor configured to send a signal to adjust the fan speed of the pressure generator, the humidity sensor being positioned in the hose.

8. A bedding system as recited in claim 4, wherein the system includes a temperature sensor and a humidity sensor, the temperature and humidity sensors each being configured to send a signal to adjust the fan speed of the pressure generator, the temperature and humidity sensors being positioned in the hose.

9. A bedding system as recited in claim 8, wherein the temperature sensor is spaced apart from the humidity sensor.

10. A bedding system as recited in claim 4, wherein the pressure generator includes a power unit, the power unit comprising a fan, the system comprising a pipe having a first end coupled to the power unit and an opposite second end removably coupled to the second end of the hose.

11. A bedding system as recited in claim 1, wherein the bottom surface and the side wall are each made from a non-porous material.

12. A bedding system as recited in claim 1, wherein the system includes a third sensor configured to send a signal to adjust the fan speed of the pressure generator, the third sensor being positioned in the hose.

13. A bedding system as recited in claim 1, wherein a portion of the first end is positioned in the cavity.

14. A bedding system as recited in claim 1, wherein the system includes a temperature sensor configured to send a signal to adjust the fan speed of the pressure generator, the temperature sensor being positioned in the hose.

15. A bedding system as recited in claim 1, wherein the system includes a humidity sensor configured to send a signal to adjust the fan speed of the pressure generator, the humidity sensor being positioned in the hose.

16. A bedding system as recited in claim 1, wherein the system includes a temperature sensor and a humidity sensor, the temperature and humidity sensors each being configured to send a signal to adjust the fan speed of the pressure generator, the temperature and humidity sensors being positioned in the hose.

17. A bedding system as recited in claim 16, wherein the temperature sensor is spaced apart from the humidity sensor.

18. A bedding system as recited in claim 1, wherein the pressure generator includes a power unit, the power unit comprising a fan, the system comprising a pipe having a first end coupled to the power unit and an opposite second end removably coupled to the second end of the hose.

19. A bedding system consisting of:

a mattress including a top wall comprising a sleep surface and an opposite inner surface, the sleep surface having a plurality of air transfer ports, the air transfer ports being uniformly spaced apart, the sleep surface defining an unobstructed topmost surface of the mattress, the sleep surface being made from a breathable material, the air transfer ports being larger than any pores inherently present in the breathable material, the mattress including a bottom wall comprising a bottom surface and an opposite inner surface, the bottom surface being opposite the sleep surface, the mattress comprising a side wall that connects the top wall and the bottom wall, the bottom wall and the side wall being made of a material that prevents air flow therethrough, the inner surfaces of the top and bottom walls and an inner surface of the side wall defining a cavity having a plurality of springs disposed therein such that the springs continuously from the inner surface of the top wall to the inner surface of the bottom wall, at least one of the walls defining a hole extending therethrough, the hole being in communication with the cavity;

a hose comprising a first end positioned in the hole such that the first end extends into the cavity and the hose is positioned equidistant between the top and bottom walls; and a pressure generator coupled to a second end of the hose; and first and second sensors each configured to send a signal to adjust a fan speed of the pressure generator if a temperature exceeds a selected threshold temperature, the first sensor being positioned in the mattress, the second sensor directly engaging the sleep surface and being positioned directly between two of the air transfer ports such that the second sensor is spaced apart from each of the air transfer ports, wherein the pressure generator is configured to create negative pressure to draw air, moisture or particles in the air transfer ports and/or the cavity through the cavity and into the pressure generator, wherein the breathable material is made up of a plurality of woven fibers, the fibers being cut so that the air transfer ports each extend through one or more of the fibers, each of the air transfer ports dividing one or more of the fibers into a first portion and a second portion that is separated from the first portion by one of the air transfer ports.

20. A bedding system consisting of:

a mattress including a top wall comprising a sleep surface and an opposite inner surface, the sleep surface having a plurality of air transfer ports, the air transfer ports being uniformly spaced apart, the sleep surface defining an unobstructed topmost surface of the mattress, the sleep surface being made from a breathable material, the air transfer ports being larger than any pores inherently present in the breathable material, the mattress including a bottom wall comprising a bottom surface and an opposite inner surface, the bottom surface being opposite the sleep surface, the mattress including a side wall that connects the top wall and the bottom wall, the bottom wall and the side wall being made of a material that prevents air flow therethrough, the inner surfaces of the top and bottom walls and an inner surface of the side wall defining a cavity having a plurality of springs disposed therein such that the springs extend continuously from the inner surface of the top wall to the inner surface of the bottom wall, the cavity having a uniform height between opposite sides of the side wall and opposite ends of the side wall, the height being defined by a distance between the inner surfaces of the top and bottom walls, at least one of the walls defining a hole extending therethrough, the hole being in communication with the cavity;

a hose comprising a first end positioned in the hole such that the first end extends into the cavity, the hose being positioned equidistant between the top and bottom walls; and a pressure generator coupled to a second end of the hose;

first and second sensor each configured to send a signal to adjust a fan speed of the pressure generator if a temperature exceeds a selected threshold temperature, the first sensor being positioned in the mattress, the second sensor engaging the sleep surface and being positioned directly between two of the air transfer ports such that the second sensor is spaced apart from each of the air transfer ports;

a temperature sensor configured to send a signal to adjust the fan speed of the pressure generator if a temperature exceeds a selected threshold temperature, the temperature sensor being positioned in the hose; and a humidity sensor configured to send a signal to adjust the fan speed of the pressure generator if a humidity exceeds a selected threshold humidity, the temperature humidity being positioned in the hose such that the humidity sensor is spaced apart from the temperature sensor, wherein the pressure generator is configured to create negative pressure to draw air, moisture or particles in the air transfer ports and/or the cavity through the cavity and into the pressure generator, and wherein the breathable material is made up of a plurality of non-woven fibers, the fibers being cut so that the air transfer ports each extend through one or more of the fibers, each of the air transfer ports dividing one or more of the fibers into a first portion and a second portion that is separated from the first portion by one of the air transfer ports.

* * * * *